US006830403B2

(12) United States Patent
Tsai

(10) Patent No.: US 6,830,403 B2
(45) Date of Patent: Dec. 14, 2004

(54) LIGHT-EMITTING PEN WITH A LIGHT REFLECTING CHAMBER

(76) Inventor: Hsueh Chen Tsai, 3855 Brandon St., Burnaby (CA), V5G 2P6

( * ) Notice: Subject to any disclaimer, the term of this patent is extended or adjusted under 35 U.S.C. 154(b) by 51 days.

(21) Appl. No.: 10/367,030

(22) Filed: Feb. 19, 2003

(65) Prior Publication Data

US 2004/0161288 A1 Aug. 19, 2004

(51) Int. Cl.[7] ..... B43K 29/00
(52) U.S. Cl. ..... 401/195; 401/52
(58) Field of Search ..... 401/52, 195

(56) References Cited

U.S. PATENT DOCUMENTS 4,028,540 A * 6/1977 Key et al. ..... 362/118
4,518,274 A * 5/1985 Hanggi ..... 401/195
5,143,465 A * 9/1992 Hou ..... 401/195
5,483,429 A * 1/1996 Chu ..... 362/118
5,730,539 A * 3/1998 Chabria ..... 401/195
6,164,856 A * 12/2000 Lo ..... 401/52

* cited by examiner

*Primary Examiner*—Huyen Le

(57) ABSTRACT

A writing implement having a built-in illumination system and a light reflecting chamber includes a transparent cone of front pen tube accommodating an ink cartridge, a hollow cylindrical barrel surrounded by a light reflecting tube, a middle ring housing the light-emitting body and an annular light reflecting plate, a power chamber housed in the rear pen tube and consisting of a LED conducting wire channel and a battery room, a conducting spring, a push tube, a switching cap, and a pen cap with clip protecting the ink cartridge tip. When light switches on, a part of the emitted light passes straightly and directly toward the cone of front pen tube through the hollow of the front pen tube to light up the surface to be written on, simultaneously, another part of the light is reflected at the surface of the annular light reflecting plate and the polished mirror-like inner wall surface of the light reflecting tube and is propagated toward the cone of front pen tube. As a result, the emitted light portion hidden by the ink cartridge is indirectly covered back and illuminates the surface to be written on. Consequently, illumination is enhanced, a more even illumination result achieved, and a shadow made by the ink cartridge is reduced or eliminated.

15 Claims, 7 Drawing Sheets

LIGHT-EMITTING PEN WITH A LIGHT REFLECTING CHAMBER

BACKGROUND OF INVENTION

1. Field of the Invention

This invention relates to a pen with a light-emitting body allowing users to write in the dark, and particularly to a light-emitting pen with a light reflecting and enhancing chamber which reduces the illuminated area, concentrates the light to the targeting area, and achieves a more even and brighter lighting result on the surface to be written on.

2. Description of Related Art

In the prior art, light-emitting pens may incorporate a slim flash light attached to the pen, or integrate a light-emitting body into the body of the pen. Typically, a transparent front pen tube is used to allow light goes through.

Generally, the light-emitting pens of the prior art encounters two problems, the ineffective lighting result and the shadow caused by the light blocking off of the ink cartridge.

To compensate the ineffectiveness of lighting, usually the light-emitting body is located relatively close to the pen tip; thus, a shorter ink cartridge is employed and a short usage life of pen can not be voided. In the case of purposely elongating the usage life of pen, making up for the short length of ink cartridge, an ink cartridge of larger diameter may be used; however, it causes more shadow problem, duce to more light blocking off by the cartridge itself.

The disadvantage or prior art mentioned here is shown in FIG. 5. In FIG. 5, it shows a less controlled light propagating, spreading light over the surrounding space through a long transparent front pen tube, rather than having light toward to the targeting area to be written on. And, less illumination on the targeting area to be written on occurs due to part of the emitted light being wasted. Furthermore, the spreading over light may cause a shining that is uncomfortable to eyes when trying to concentrate viewing at the surface to be written on. Besides, a dark shadow, usually at the area around the writing pen tip, limits the purpose of a light-emitting pen.

Design of the present invention incorporates a "light reflecting chambers". A light reflecting chamber recovers part of the emitted light that goes to the cylindrical side of front pen tube rather than going directly to the pen tip. It reflects light and indirectly propagates the light toward the pen tip, hence, enhancing the total illumination on the surface to be written on. Further more, the additional light recovering, reflected from the cylindrical rim of light reflecting chamber to the pen tip as a effect of side illuminating, reduces or eliminates the shadow, caused from light blocking off by the ink cartridge. As illustrated in FIG. 4, this lighting pattern also helps avoiding the uncomfortable shining to the eyes as mentioned above.

SUMMARY OF INVENTION

The present invention is directed to a light-emitting pen with which writing in dark becomes more convenient because of a improved illumination, due to the design of the present invention that employs a light reflecting chamber in the light-emitting pen.

In an embodiment of the invention, a writing implement with a built-in illumination system has a transparent cone of front pen tube accommodating an ink cartridge, a hollow cylindrical barrel surrounded by a light reflecting tube, a middle ring housing the light-emitting body and an annular light reflecting plate, a power chamber housed in the rear pen tube and consisting of a LED conducting wire channel and a battery room, a conducting spring, a push tube, a switching cap, and a pen cap with clip protecting the ink cartridge tip.

When light switches on, a part of the emitted lightpasses straightly and directly toward the cone of front pen tube through the hollow of the front pen tube to light up the surface to be written on, simultaneously, another part of the light is reflected at the surface of the annular light reflecting plate and the polished mirror-like inner wall surface of the light reflecting tube and is propagated toward the cone of front pen tube. As a result, the emitted light portion hidden by the ink cartridge is indirectly covered back and illuminates the surface to be written on. Consequently, illumination is enhanced, a more even illumination result achieved, and a shadow made by the ink cartridge is reduced or eliminated.

The various objects and advantages of the present invention will be more readily understood from the following detailed description when read in conjunction with the appended drawing.

BRIEF DESCRIPTION OF DRAWINGS

FIG. 9 is a perspective view showing the extended conducting spring, of the present invention, contacting the electrode of battery, when switches on.

DETAILED DESCRIPTION

Figure 1:
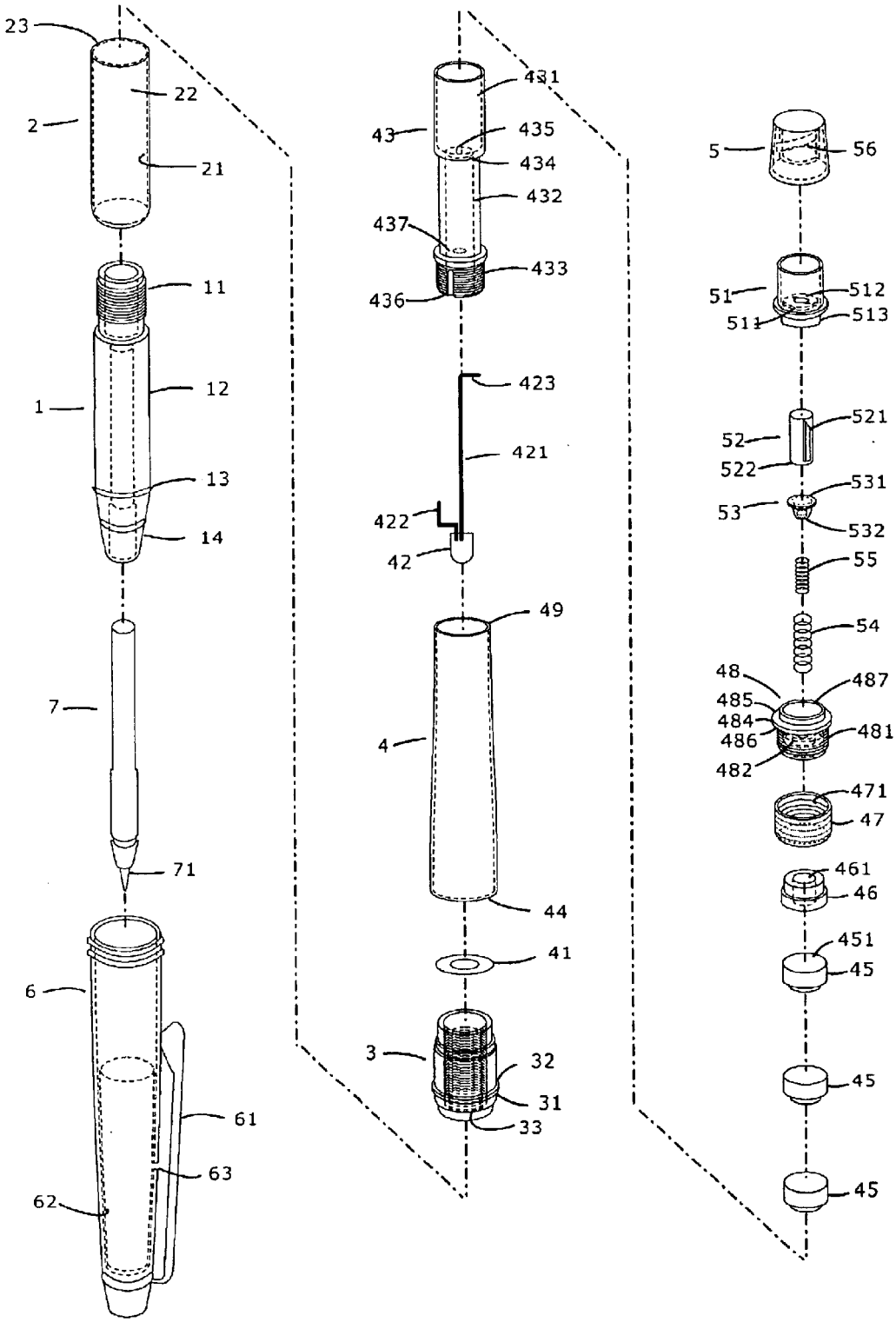
FIG. 1 shows an exploded perspective view of the light-emitting pen of the present invention.

FIG. 1 is an exploded perspective view of the light-emitting pen of the present invention.

Figure 2:
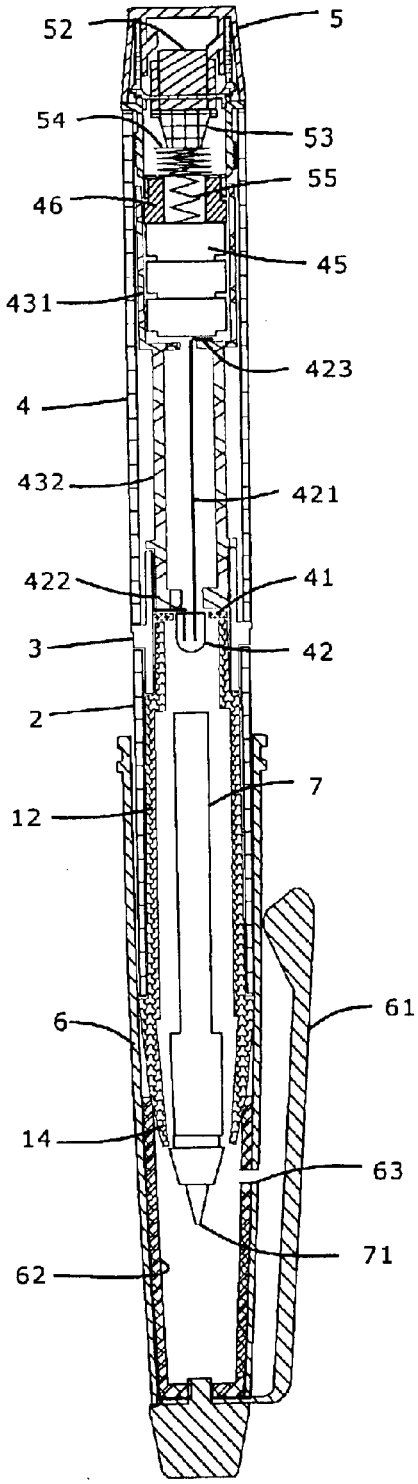
FIG. 2 shows a cross sectional view of the light-emitting pen of the present invention.
Figure 3:
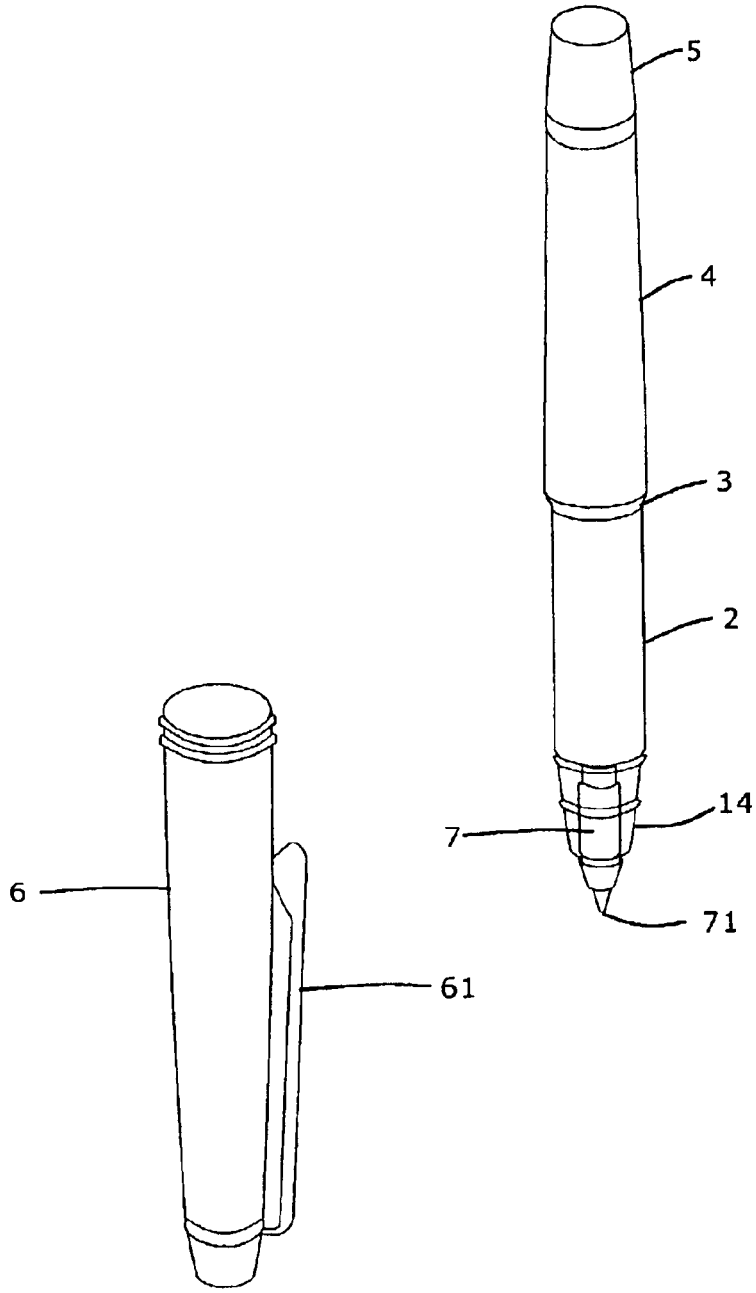
FIG. 3 shows a perspective view of the light-emitting pen of the present invention.
Figure 4:
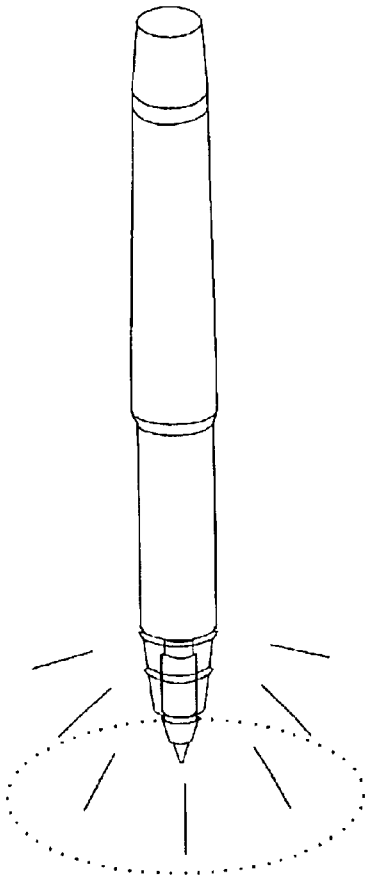
FIG. 4 shows a perspective view showing that the light-emitting pen of the present invention lights up.
Figure 5:
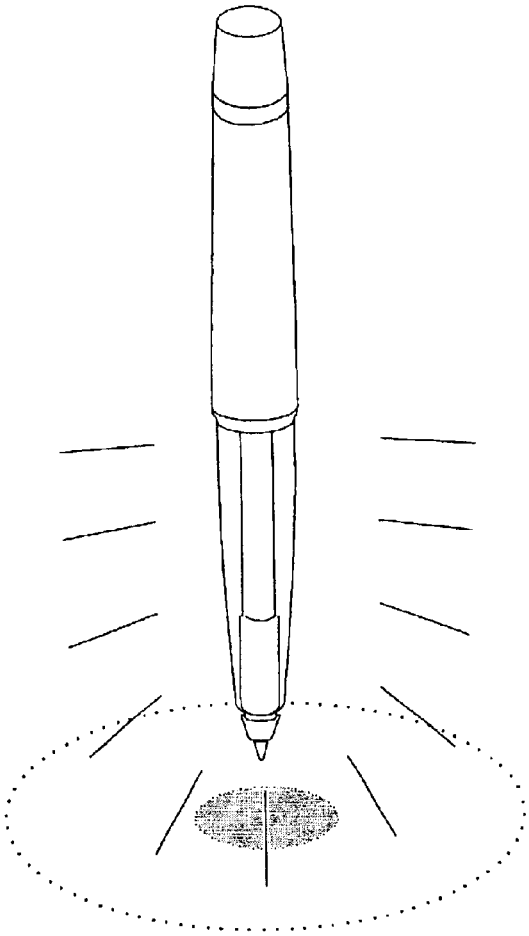
FIG. 5 illustrates a perspective view of a light-emitting pen with no light reflecting tube lights up.
Figure 6:
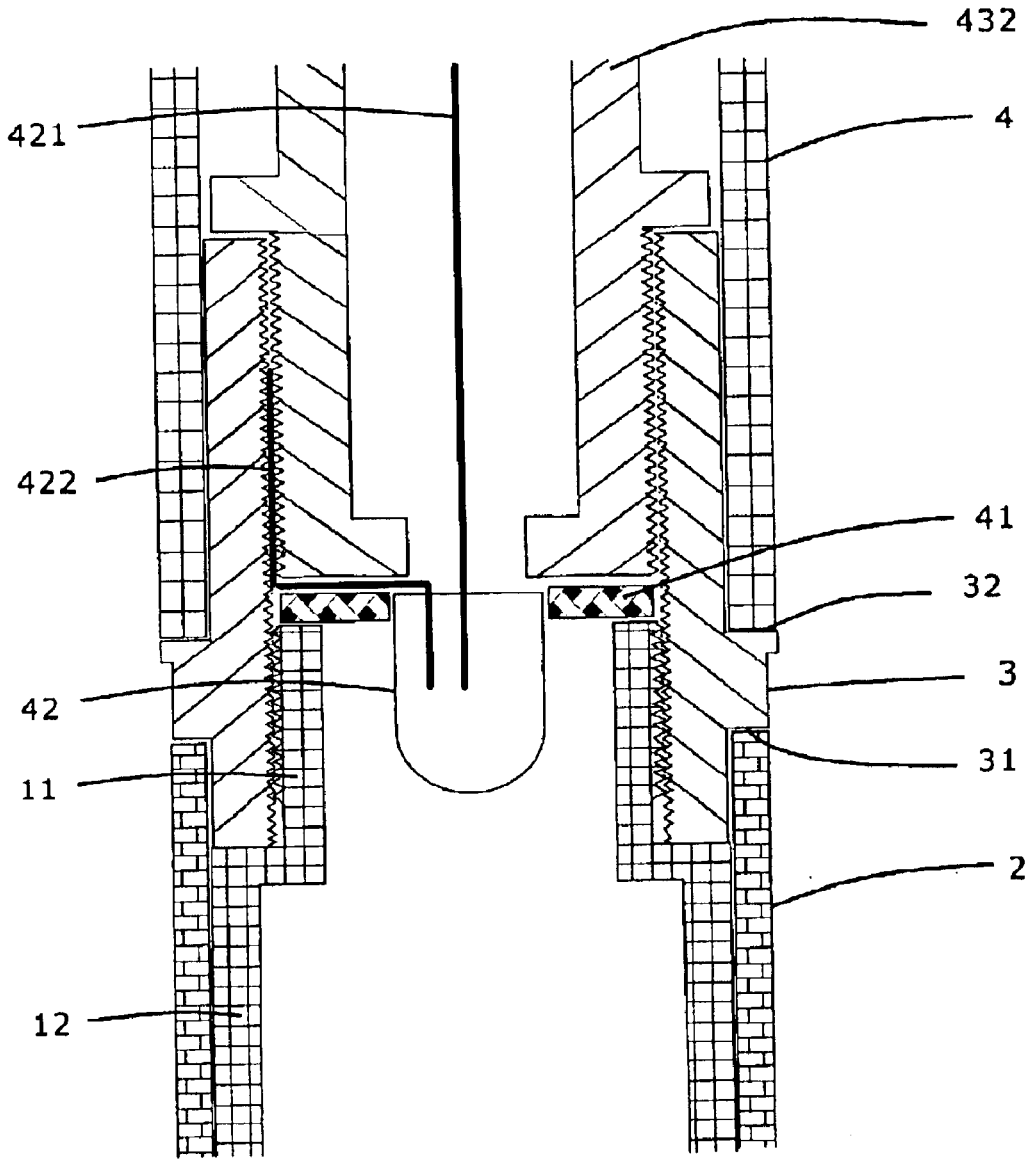
FIG. 6 is a schematic view of the middle ring of the present invention.
Figure 7:
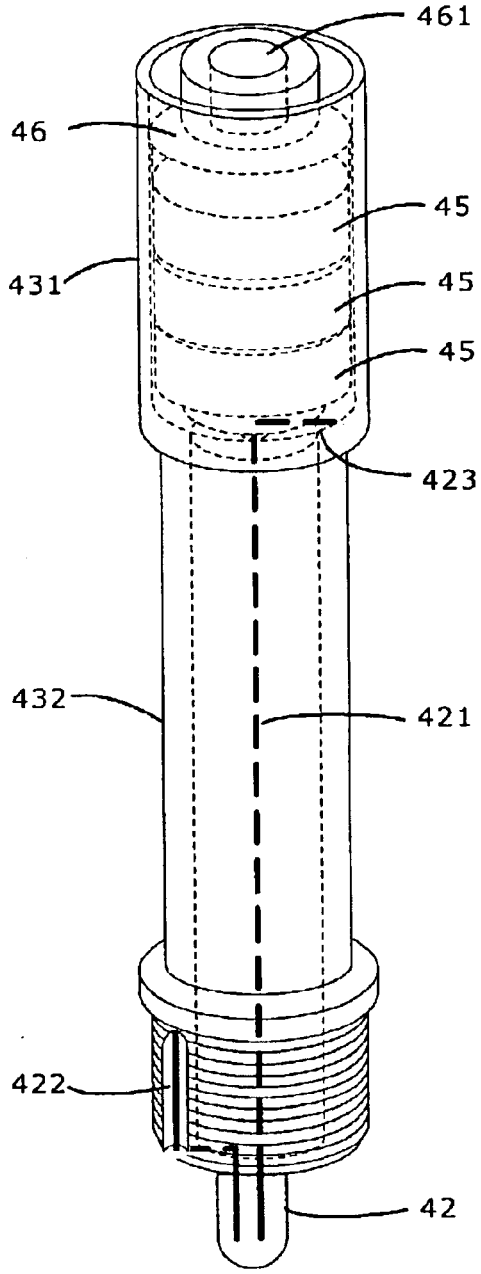
FIG. 7 is a perspective view of power chamber together with the light-emitting body of the present invention.
Figure 8:
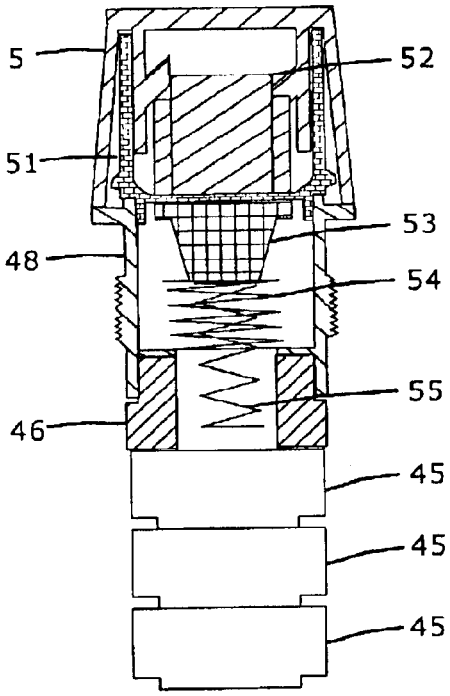
FIG. 8 is a perspective view showing the non-extended conducting spring, of the present invention, when switches off.
Figure 9:
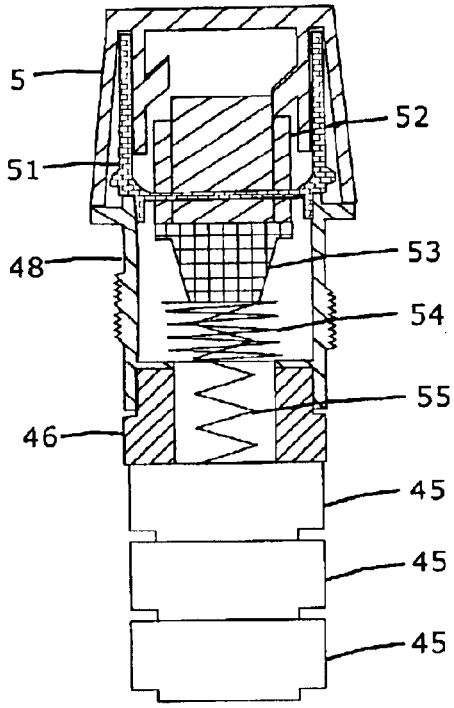

FIG. 2 is a cross sectional view of the light-emitting pen of the present invention which has been assembled, and FIG. 6, 7, 8, 9 are enlarged sectional partial views of the light-emitting pen of the present invention.

As shown in FIG.1 and FIG. 2, the light-emitting pen with a light reflecting chamber has generally a transparent cone of front pen tube 14 accommodating an ink cartridge 7, a hollow cylindrical barrel 12 surrounded by a light reflecting tube 2, a middle ring3 housing the light-emitting body 42 and an annular light reflecting plate 41 and combining front pen tube 1 and rear pen tube 4 by a thread and groove conjugation, a power chamber 43 housed in the rear pen tube 4 and consisting of a LED conducting wire channel 432 and a battery room 431, a conducting spring 55, a push tube 52, a switching cap 5, and a separable pen cap 6 with clip 61 covering and protecting the ink cartridge tip 71. The cap has a small hole 63 allowing light inside to be seen and functioning as a light indicator when the writing implement being capped and lighted. There is also a plastic cushion 62 installed inside the pen cap 6 to firmly hold the pen body.

The front pen tube 1 is separated into 3 sections, cone of front pen tube 14, hollow cylindrical barrel 12, and threaded tube 11. A cylindrical light reflecting tube 2, major part of the light reflecting chamber, covers the cylindrical barrel section 12 and the threaded tube section 11 of the front pen tube 1.

Front pen tube 1 has a hollow structure and is constructed of a transparent material, preferably an acrylic polymer to favor light transferring. Cylindrical barrel section 12 of front pen tube 1 has a smaller diameter than that of a light reflecting tube 2 and, thus, the light reflecting tube 2 covers around the cylindrical barrel section 12. After assembly, light reflecting tube 2 locates between lower side of the stopping post 31 of the middle ring 3 and the stopping post 13 of the front pen tube. The inner surface 21 of light reflecting tube 2 is fully polished to be shining and bright as a mirror-like surface which fully reflects the light. The outer surface 22 of light reflecting tube 2 has a color matching the color of rear pen tube 4 to give an integral and uniform product color of pen body. Light reflecting tube 2 is preferably metal made. The mirror-like inner surface 21 of light reflecting tube 2 together with the annular light reflecting plate 41 propagates the emitted light from the light-emitting body 42, generally a light emitting diodes, toward the cone of front pen tube 14 and surface to be written on, to give a maximum illuminating result.

Middle ring 3 has a threaded groove 33 to adopt both threaded tube 11 of front pen tube land threaded tube 433 of power chamber 43, and is fixed in place in the rear pen tube 4, therefore, conjugating the front pen tube 1 and rear pen tube 4. The upper side 32 of the stopping post of the middle ring 3 resists against the lower opening end 44 of the rear pen tube 4 and the lower side 31 of the stopping post of the middle ring 3 resists against the upper opening end 23 of the light reflecting tube 2. Middle ring 3 also accommodates the annular light reflecting plate 41, a light-emitting body 42, and LED seat 437 sequentially. The annular light reflecting plate 41, preferably made of plastic material with one mirror-like side facing downward the writing tip, together with the light reflecting tube 2 forms the light reflecting chamber.

LED seat 437 supports and holds the light-emitting body 42. The threaded tube 433 allows the power chamber 43 screws into the middle ring 3. The lower side 411, the side facing to cone of front pen tube, of light reflecting plate 41 is coated or painted with light reflecting material to create a shining and bright or a mirror-like surface and perform light reflecting function to forward light to the cone 14 of front pen tube 1. The lower side 411 of annular light reflecting plate 41 together with the mirror-like inner surface 21 of middle section tube 2 forms a light reflecting and enhancing chamber.

The main body of the light-emitting system, housed inside the rear pen tube 4, consists of a light-emitting body 42, LED seat 437, and power chamber 43. The power chamber 43 is separated into three sections, the battery room 431, the LED conducting wire channel 432, and a threaded tube 433.

A trench 436 is made on the outer surface of threaded tube 433 of power chamber 43. The trench 436 allows the short LED conducting wire 422 fitting in and, therefore, being well positioned to the right place. The short LED conducting wire 422 remains contacting the electricity transferable inner wall of the rear pen tube 4.

The bottom 434 of battery room 431 has a small hole 435, allowing the long LED conducting wire 421 go through. The very end 423 of long LED conducting wire 421 is shaped a upside down "L" and rests on the bottom 434 of battery room 431, making the end of conducting wire keep contacting with the battery in the battery room 431.

The battery 45 and fastening rubber ring 46 are sequentially installed in the battery room 431. The fastening rubber ring 46 presses on the batteries 45 to keep them firmly contacted to each other to ensure the integrity of circuit that lights up the light-emitting body42. The rubber ring hole 461 allows the conducting spring 55 goes through when the switching cap 5 switches on. When switching on, the conducting spring 55 moves down to contact the battery 45, thus, the electric circuit accomplishes and the light-emitting body 42 lights up.

The switching-on system is provided by a combination of switching cap 5 with ratchet teeth 56 inside, a push tube 52, a joint 53, a conducting spring 55, a supporting sprint 54, a switching base 51, and a switching base holder 48. The lower rim 513 of switching base 51 mounts into the upper rim 487 of the switching base holder 48. Thread 481 of the switching base holder 48 goes to the groove 471 of the adopting tube 47 that is fixed in place inside the upper end 49 of rear pen tube 4.

A supporting spring 54 locates between joint 53 and annular plate 482 of switching base holder 48 to push back the push tube 52 after the ratchet teeth 56 releases the push tube 52. A teeth shaped hole 512 at the center of the annular plate 511 of the switching base 51 fits the push tube 52 and its teeth 521. And, the switching base holder 48 has a hole at the center of its annular plate 482 allowing conducting spring 55 going through.

The stopping post 484 has a larger diameter for resisting the switching cap at its upper side 485 and against rear pen tube 4 at its lower side 486.

The switching on function is accomplished by rotating the switching cap 5 to press down the push tube 52 downward by the ratchet teeth 56 built inside. The push tube 52 further moves down the joint 53 and, sequentially, the conducting spring 55 which extends through the rubber ring hole 461 and makes direct electrical contact with the electrode 451 of battery 45. The joint 53 has two cavities 531, 532 firmly holding the push tube 52, by the second cavity 531, and the conducting spring 55, by the first cavity 532. When the conducting spring 55 gets in contact with the electrode 451 of battery, the electrical circuit forms starting from the electrode 451 through conducting spring 55, joint 53, annular plate 511 of switching base 51, the switching base holder 48, the threaded adopting tube 47, inner wall of rear pen tube 4, short LED conducting wire 422, light-emitting body 42, long LED conducting wire 421, and, finally, the other electrode of battery 45. All the mentioned elements 451, 55, 53, 511, 51, 48, 47, 4, 422, 42, 421 in the electrical circuit are metal made or electricity transferable. Electrical connection is broken simply by another rotating of the switching cap 5 that draws back the conducting spring 55, pushed back by the supporting spring 54, and disconnects the electrode 451 of battery 45.

When writing in the dark, user can rotate the switching cap 5 and the electric circuit forms. Accordingly, the light-emitting body 42 comes to be supplied with electrical energy from the battery 45 to emit light. A part of the light emitted by the light-emitting body 42 passes straightly through the hollow of front pen tube 1 directly toward the cone of front pen tube 14, simultaneously, another part of the light is reflected at the annular light reflecting plate 41 and the polished mirror-like inner wall surface 21 of the light reflecting tube 2 and propagates light toward the cone of front pen tube 14. Therefore, the portion, on the surface to be written on, that is supposedly having a light blocking off by the ink cartridge is indirectly illuminated, so that a shadow made by the ink cartridge is reduced or eliminated, illumination is enhanced, and a more even illumination result achieved.

What is claimed is:

1. A writing implement having a built-in illumination system and a light reflecting chamber comprising:

a front pen tube having three sections, cone of front pen tube, cylindrical barrel, and threaded tube, said front pen tube having a hollow space and housing an ink cartridge;

an ink cartridge accommodated in the front pen tube;

a cylindrical light reflecting tube covering the cylindrical barrel section and the threaded tube section of the front pen tube, said reflecting tube functioning as the major part of a light reflecting chamber;

a annular light reflecting plate located behind a light-emitting body or surrounding a light-emitting body;

a middle ring positioned between the front pen tube and rear pen tube, said middle ring combining front pen tube and rear pen tube by a thread and groove conjugation;

a rear pen tube housing a power system consisting of a light-emitting body, a power chamber, and part of the switching on system, said power chamber comprising of a threaded tube, a LED conducting wire channel and a battery room;

a switching on system including a switching cap, a push tube, a joint, and a conducting spring;

a separable pen cap covering and protecting the ink cartridge tip and having a clip, said pen cap having a small hole allowing light inside to be seen and functioning as a light indicator when the writing implement being capped and lighted.

2. The writing implement according to claim 1, wherein said front pen tube is constructed of a light transferable material, preferably an acrylic polymer.

3. The writing implement according to claim 1, wherein said barrel section of the front pen tube is cylindrically shaped to favor the light reflecting result caused by a light reflecting tube which is also cylindrically shaped and covers over the barrel section.

4. The writing implement according to claim 1, wherein said light reflecting chamber comprises of a light reflecting tube, an annular reflecting plate, and a middle ring, said middle ring houses the annular reflecting plate, a light-emitting body, LED seat, and threaded tube of the power chamber.

5. The writing implement according to claim 4, wherein said light reflecting tube has a polished mirror-like inner surface to fully reflect emitted light from the light-emitting body.

6. The writing implement according to claim 4, wherein said annular light reflecting plate is coated or painted with light reflecting material on the side facing to the pen tip and serves as part of the light reflecting chamber to propagate emitted light toward the pen tip.

7. The writing implement according to claim 1, wherein said power chamber has a trench on the threaded tube therein holding one conducting wire of the light-emitting body, said power chamber has a LED conducting wire channel accommodating another conducting wire of the light-emitting body, said power chamber has a battery room housing batteries.

8. The writing implement according to claim 7, wherein said trench keeps the LED conducting wire in contact with the electricity transferable middle ring which further contacts an electricity transferable inner wall of rear pen tube.

9. The writing implement according to claim 7, wherein said battery room has a small hole at the center of battery room bottom allowing a LED conducting wire going through and contacting the battery.

10. The writing implement according to claim 1, wherein said LED conducting wire channel has an annular bottom functioning as a seat of a light-emitting body and as a base of the annular light reflecting plate.

11. The writing implement according to claim 1, wherein said switching on system turns on the electric power and light up the light-emitting body when rotates the switching cap clockwise.

12. The writing implement according to claim 11, wherein rotating said switching cap presses down a push tube by its ratchet teeth and the push tube moves a joint and a conducting spring downward consequently to contact an electrode of battery.

13. The writing implement according to claim 12, wherein said push tube backs up and breaks the electric circuit at the second rotating of switching cap.

14. The writing implement according to claim 13, wherein a supporting spring pushes back the said push tube at the second rotating of switching cap that release the ratchet teeth off.

15. The writing implement according to claim 11, wherein said electric power turns off after another clockwise rotating of the switching cap.

* * * * *